US008484926B1

(12) United States Patent
Caruso

(10) Patent No.: US 8,484,926 B1
(45) Date of Patent: Jul. 16, 2013

(54) FRAME MEMBER TO WHICH SCREEN MATERIAL CAN BE ATTACHED FOR FORMING SCREEN DOORS, SCREEN WALLS AND WINDOW SCREENS

(76) Inventor: Michael Caruso, Wallingford, CT (US)

( * ) Notice: Subject to any disclaimer, the term of this patent is extended or adjusted under 35 U.S.C. 154(b) by 0 days.

(21) Appl. No.: 13/092,925

(22) Filed: Apr. 23, 2011

Related U.S. Application Data

(60) Provisional application No. 61/430,380, filed on Jan. 6, 2011.

(51) Int. Cl.
*E04C 2/38* (2006.01)

(52) U.S. Cl.
USPC ..... 52/656.7; 52/222

(58) Field of Classification Search
USPC ..... 52/656.7, 222, 202, 203, 63
See application file for complete search history.

(56) References Cited

U.S. PATENT DOCUMENTS

| | | | | | |
|---|---|---|---|---|---|
| 2,835,325 | A | | 5/1958 | Gilbert et al. | 160/369 |
| 2,837,153 | A | | 6/1958 | Brown et al. | 160/371 |
| 3,143,165 | A | | 8/1964 | Lewis | |
| 3,222,841 | A | | 12/1965 | Lipof | 52/482 |
| 3,382,639 | A | | 5/1968 | Smith et al. | 52/844 |
| 4,057,941 | A | | 11/1977 | Schwartz | 52/63 |
| 4,084,360 | A | | 4/1978 | Reckson | 52/63 |
| 4,189,880 | A | * | 2/1980 | Ballin | 52/202 |
| 4,232,310 | A | | 11/1980 | Wilson | 340/550 |
| 4,233,790 | A | * | 11/1980 | Meadows | 52/222 |
| 4,261,144 | A | | 4/1981 | Rizzo | 52/63 |
| 4,333,284 | A | * | 6/1982 | Meadows | 52/222 |
| 4,410,027 | A | | 10/1983 | Lucous | |
| 4,662,038 | A | | 5/1987 | Walker | |
| 4,690,192 | A | | 9/1987 | Stilling | 160/57 |
| 4,799,299 | A | * | 1/1989 | Campbell | 24/462 |
| 5,076,033 | A | | 12/1991 | Patsy, Jr. | 52/222 |
| 5,117,598 | A | * | 6/1992 | Livingston et al. | 52/222 |
| 5,143,138 | A | * | 9/1992 | Zwart | 160/395 |
| 5,209,029 | A | * | 5/1993 | Foerst | 52/63 |
| 5,469,672 | A | * | 11/1995 | Fisher | 52/74 |
| 5,502,906 | A | * | 4/1996 | Yamawaki | 38/102 |
| 5,545,488 | A | | 8/1996 | Burke | 428/586 |
| 5,613,544 | A | | 3/1997 | Schaefer | |
| 5,647,176 | A | * | 7/1997 | Milliken et al. | 52/63 |
| 5,737,885 | A | | 4/1998 | Stoyke | 52/202 |
| 5,794,400 | A | * | 8/1998 | Fisher et al. | 52/844 |
| 5,803,145 | A | | 9/1998 | Lamb | 160/90 |
| 5,887,391 | A | | 3/1999 | Shoup | |

(Continued)

*Primary Examiner* — Mark Wendell
(74) *Attorney, Agent, or Firm* — Raymond A. Nuzzo

(57) ABSTRACT

A frame member for use in constructing screen walls, screen doors, window screens and related structures. The frame member has an elongate channel-containing section and an elongate plate section that extends from the channel-containing section. The channel-containing section has a longitudinally extending channel that has a narrow section and a relatively wider section. The narrow section of the channel defines an entrance to the channel. The channel is sized for receiving spline that secures a screen to the frame member. The channel-containing section has a rear wall and a pair of sidewalls. Each sidewall has an outer surface. The channel-containing section has a pair of front wall sections. Each front wall section is on a corresponding side of the channel entrance. The elongate plate section has a first surface and an opposite second surface and is substantially perpendicular to the rear wall of the channel-containing section. The first surface of the elongate plate section is substantially coplanar with an outer surface of one of the sidewalls of the channel-containing section.

6 Claims, 14 Drawing Sheets

U.S. PATENT DOCUMENTS 6,061,941 A * 5/2000 Verret ..... 40/603
6,338,226 B1 1/2002 Gauthier
6,378,267 B1 * 4/2002 Bass ..... 52/656.7
6,892,787 B1 * 5/2005 Stretch ..... 160/371
6,955,022 B2 * 10/2005 Imam ..... 52/660
7,302,986 B2 12/2007 Flack

* cited by examiner

FRAME MEMBER TO WHICH SCREEN MATERIAL CAN BE ATTACHED FOR FORMING SCREEN DOORS, SCREEN WALLS AND WINDOW SCREENS

CROSS-REFERENCE TO RELATED APPLICATIONS

This application claims the benefit of U.S. provisional application No. 61/430,380, filed Jan. 6, 2011. The entire disclosure of U.S. provisional application No. 61/430,380 is hereby incorporated by reference.

TECHNICAL FIELD

The present invention generally relates to a frame member to which screen material can be attached for the purpose of forming screen doors, screen walls and window screens.

BACKGROUND ART

Frame members and related devices for constructing doors, screen doors, screen walls, window screens and other structures are described in U.S. Pat. Nos. 3,143,165, 4,189,880, 4,233,790, 4,333,284, 4,410,027, 4,662,038, 5,046,546, 5,143,138, 5,345,662, 5,613,544, 6,279,644 and 6,945,305.

DISCLOSURE OF THE INVENTION

It is a primary object and general purpose of the present invention to provide a frame member to which screen material can be attached for the purpose of forming screen doors, screen walls, and window screens. The frame member comprises an elongate channel-containing section and an elongate plate section that extends from the channel-containing section. The channel-containing section has a longitudinally extending channel that comprises a narrow section and a relatively wider section. The narrow section of the channel defines an entrance to the channel. The channel is sized to receive spline that secures a screen to the frame member. The channel-containing section comprises a rear wall and a pair of sidewalls. Each sidewall has an outer surface. The channel-containing section further comprises a pair of front wall sections. Each front wall section is on a corresponding side of the entrance to the channel. The elongate plate section has a first surface and an opposite second surface and is substantially perpendicular to the rear wall of the channel-containing section. The elongate plate section is attached to and extends from the rear wall of the channel-containing section. In one embodiment, the first surface of the elongate plate section is substantially coplanar with the outer surface of one of the sidewalls of the channel-containing section. In another embodiment, the elongate plate section is attached to and extends from the center of the rear wall of the channel containing section.

In a related aspect, the present invention is directed to a frame member to which screen material can be attached for the purpose of forming screen doors, screen walls, window screens and related structures. The frame member comprises an elongate channel-containing section and an elongate plate section that extends from the channel-containing section. The channel-containing section includes a channel that comprises a narrow section and a relatively wider section. The narrow section of the channel defines an entrance to the channel. The channel is sized for receiving spline that secures a screen to the frame member. The channel-containing section comprises a rear wall and a pair of sidewalls. Each sidewall has an outer surface. The sidewalls are substantially parallel to each other. The channel-containing section further comprises a pair of front wall sections. Each front wall section is contiguous with and substantially perpendicular to a corresponding sidewall. Each front wall section is located on a corresponding side of the entrance to the channel. The front wall sections are substantially coplanar. The elongate plate section has a first surface and an opposite second surface. The elongate plate section is substantially perpendicular to the rear wall of the channel-containing section. The first surface of the elongate plate section is substantially coplanar with the outer surface of one of the sidewalls of the channel-containing section. The channel has an interior wall that has portions located on opposite sides of the entrance of the channel. The channel-containing section includes a plurality of longitudinally extending nubs located on the portions of the interior wall that are on opposite sides of the entrance to the channel. The elongate plate section has at least one longitudinally extending crease to facilitate forming openings through the elongate plate section so as to enable the frame member to be attached to a structure.

Other aspects of the invention are described in detail in the ensuing description.

BRIEF DESCRIPTION OF THE DRAWINGS

The features of the invention are believed to be novel. The figures are for illustration purposes only and are not drawn to scale. The invention itself, however, both as to organization and method of operation, may best be understood by reference to the detailed description which follows taken in conjunction with the accompanying drawings in which.

BEST MODE FOR CARRYING OUT THE INVENTION

Figure 1:
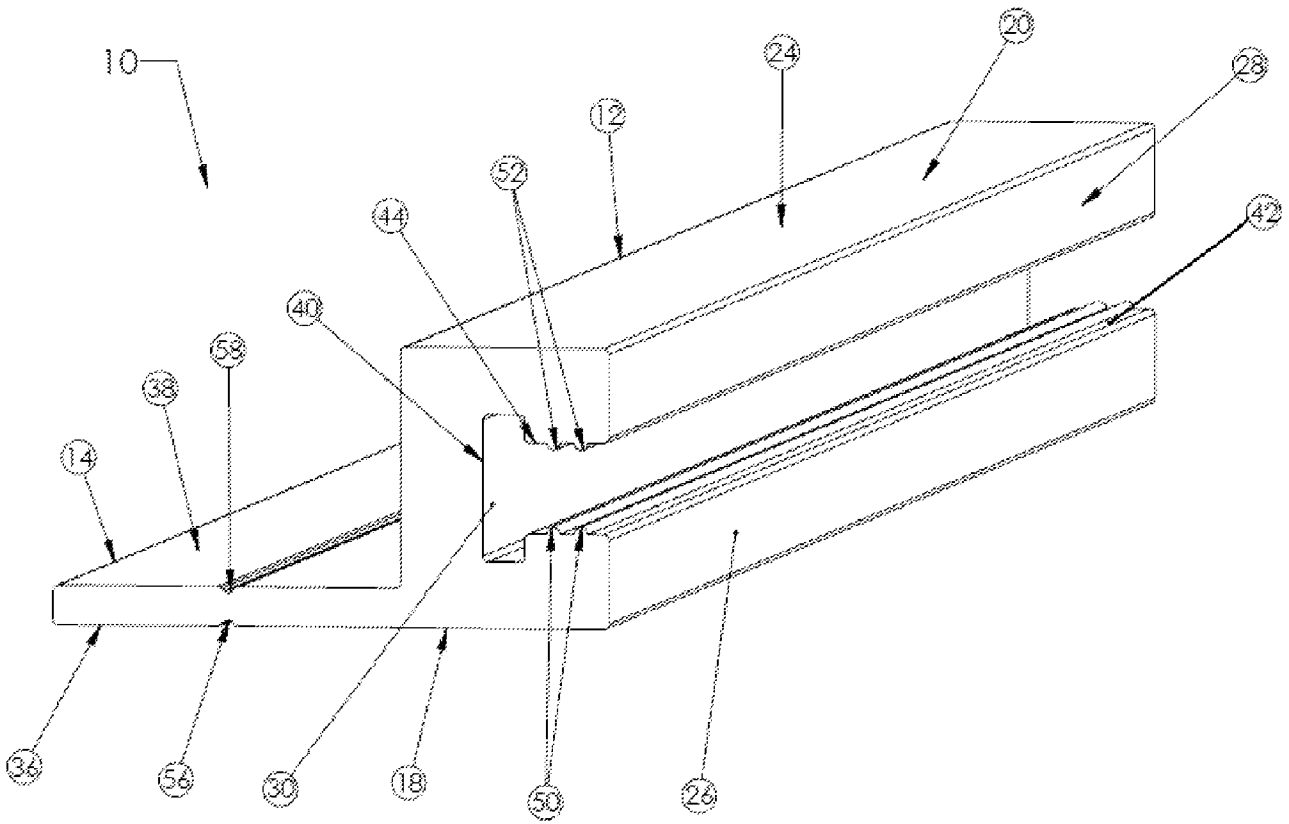
FIG. 1 is a perspective view of a frame member in accordance with one embodiment of the present invention.
Figure 2:
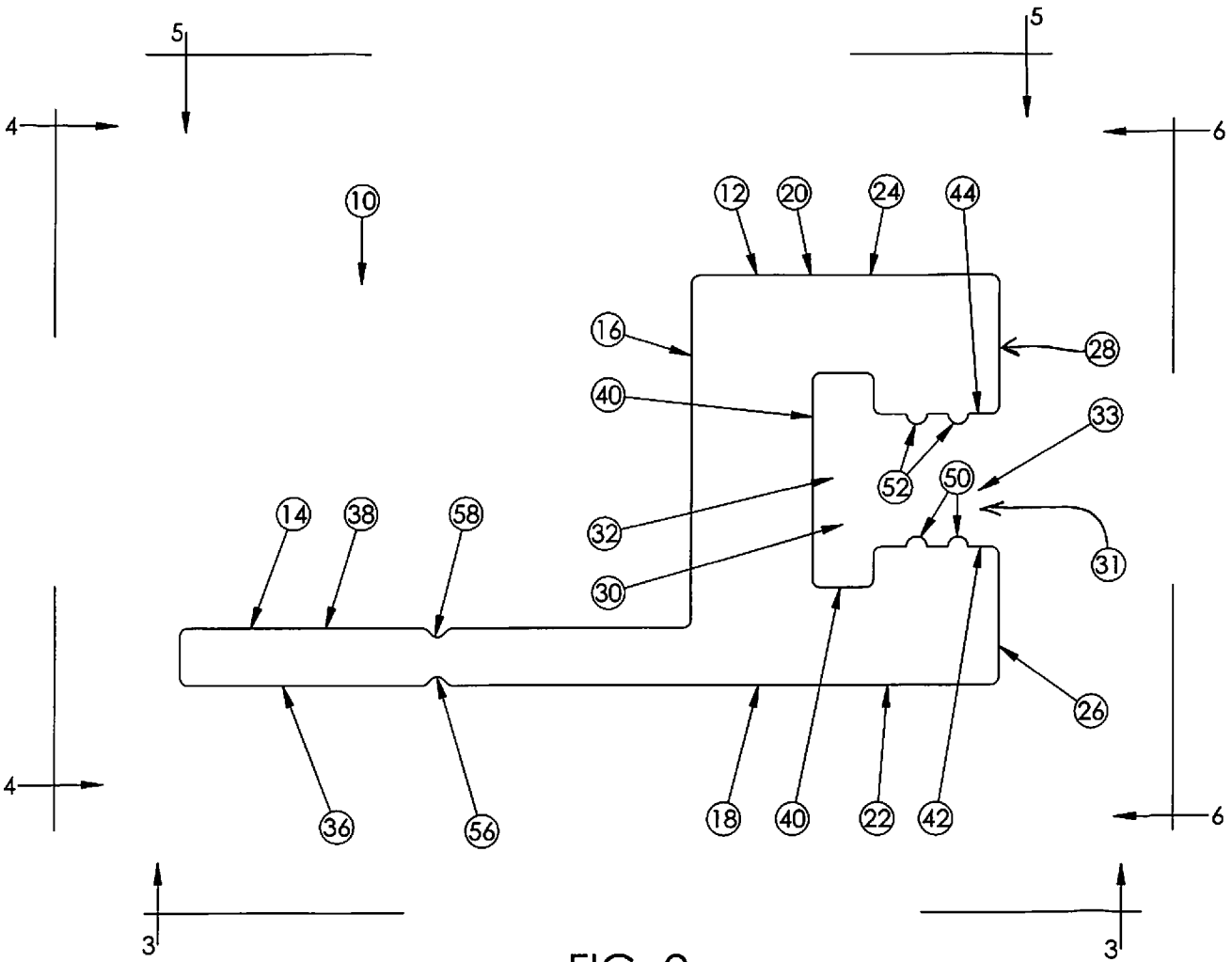
FIG. 2 is a side view of one end of the frame member of FIG. 1, the view of the opposite end being a mirror image.

Referring to FIGS. 1-6, there is shown frame member 10 of the present invention. Frame member 10 is elongated and has a predetermined length "L". Frame member 10 comprises channel-containing section 12 and plate section 14. Plate section 14 is contiguous with and extends from channel-containing section 12. Plate section 14 is rigid. In a preferred embodiment, channel containing section 12 and plate section 14 are integrally formed by an extrusion process. Thus, in a preferred embodiment, frame member 10 is not formed by attaching separate sections together. However, in an alternate embodiment, frame member 10 can be formed by attaching together a separate elongate channel-containing section 12 and separate elongate plate section 14. Referring to FIGS. 1 and 2, channel-containing section 12 comprises rear wall 16, sidewall 18 and sidewall 20. Sidewalls 18 and 20 have outer surfaces 22 and 24, respectively. Sidewalls 18 and 20 are substantially parallel to each other. Channel-containing section 12 further comprises front wall section 26 and front wall section 28. Channel-containing section 12 further comprises longitudinally extending channel 30. Channel 30 comprises section 31 and section 32. Section 32 is relatively wider than section 31. Section 31 defines channel entrance 33. Channel extends for the entire length of frame member 10. Channel 30 is sized to receive spline that secures a screen to frame member 10. Commercially available spline is made out of a variety of resilient materials, e.g. rubber, foam, poly-foam, etc. In a preferred embodiment, the spline should be configured to have a shape that conforms to the shape of channel 30 and a size that allows the spline to be frictionally inserted into channel 30. Each front wall section 26 and 28 is on a corresponding side of channel entrance 33. Front wall sections 26 and 28 are substantially coplanar. Plate section 14 has first surface 36 and opposite second surface 38. Plate section 14 is substantially perpendicular to rear wall 16 of channel-containing section 12. First surface 36 is substantially coplanar with the outer surface 22 of sidewall 18.

Referring to FIGS. 1 and 2, channel 30 has interior wall 40 that extends throughout channel 30. Interior wall 40 comprises portions 42 and 44 that confront channel entrance 33. Channel-containing section 12 further includes a plurality of longitudinally extending nubs 50 and 52 located on portions 42 and 44, respectively, of channel interior wall 40. Thus, nubs 50 are located on one side of channel entrance 33 and nubs 52 are located on the opposite side of channel entrance 33. Nubs 50 and 52 cooperate with the shape of channel 30 to retain the spline within channel 30 and to prevent longitudinal movement of the spline with respect to frame member 10 when the spline is positioned within channel 30. Although two nubs 50 are shown on interior wall portion 42 and two nubs 52 are shown on wall portion 44, it is to be understood that there can be more than or less than two nubs on interior wall portions 42 and 44.

Figure 7:
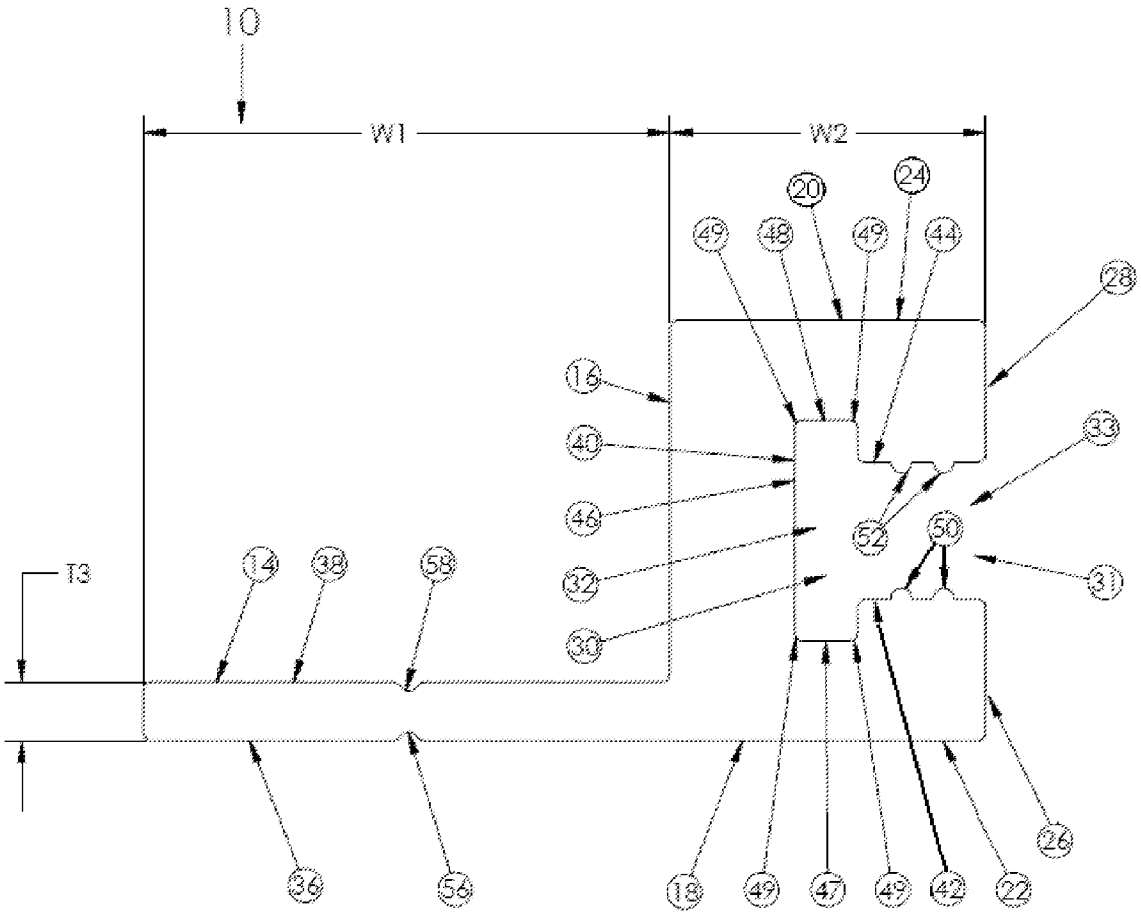
FIG. 7 is a side view which is essentially the same as the view of FIG. 2.

Referring to FIG. 7, channel 30 has a unique shape that facilitates retaining the spline in channel 30. Interior wall 40 further comprises back or rear wall portion 46 and sidewall portions 47 and 48. In accordance with the invention, rear wall portion 46 and sidewall portions 47 and 48 are substantially flat. Interior wall 40 has radiused corners 49.

Referring to FIG. 7, in one embodiment, plate section 14 has a width W1 of about 0.625 inch and channel-containing section 12 has a width W2 of about 0.375 inch. In one embodiment, plate section 14 has a thickness T of about 0.070 inch. It is to be understood that the aforesaid dimensions are just examples and all dimensions of frame member 10 can be varied to suit the particular application.

Figure 3:
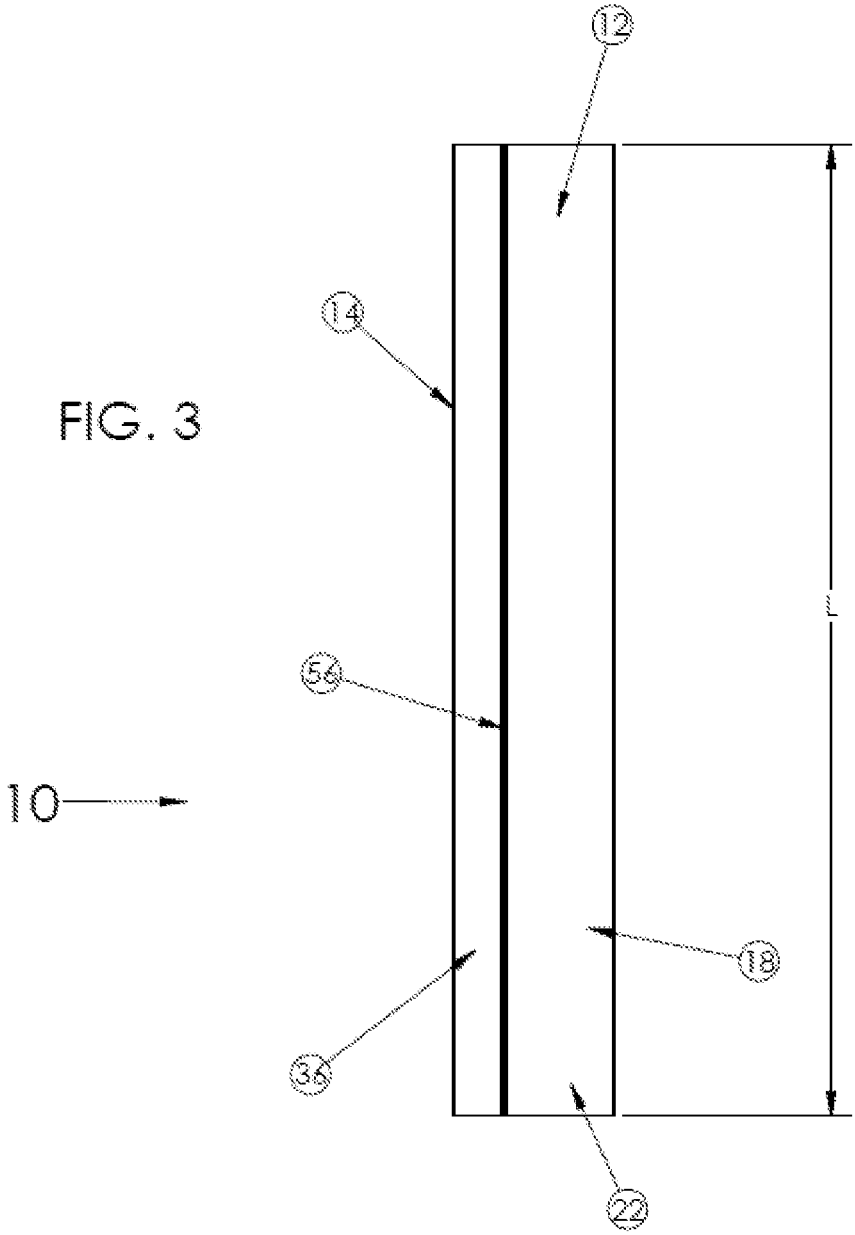
FIG. 3 is a view taken along line 3-3 in FIG. 2.
Figure 4:
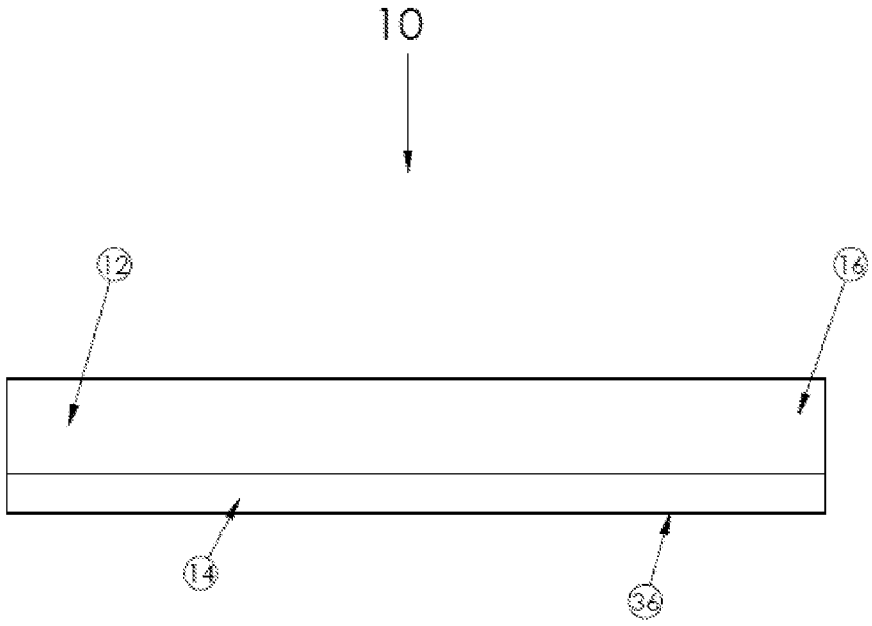
FIG. 4 is a view taken along line 4-4 in FIG. 2.
Figure 5:
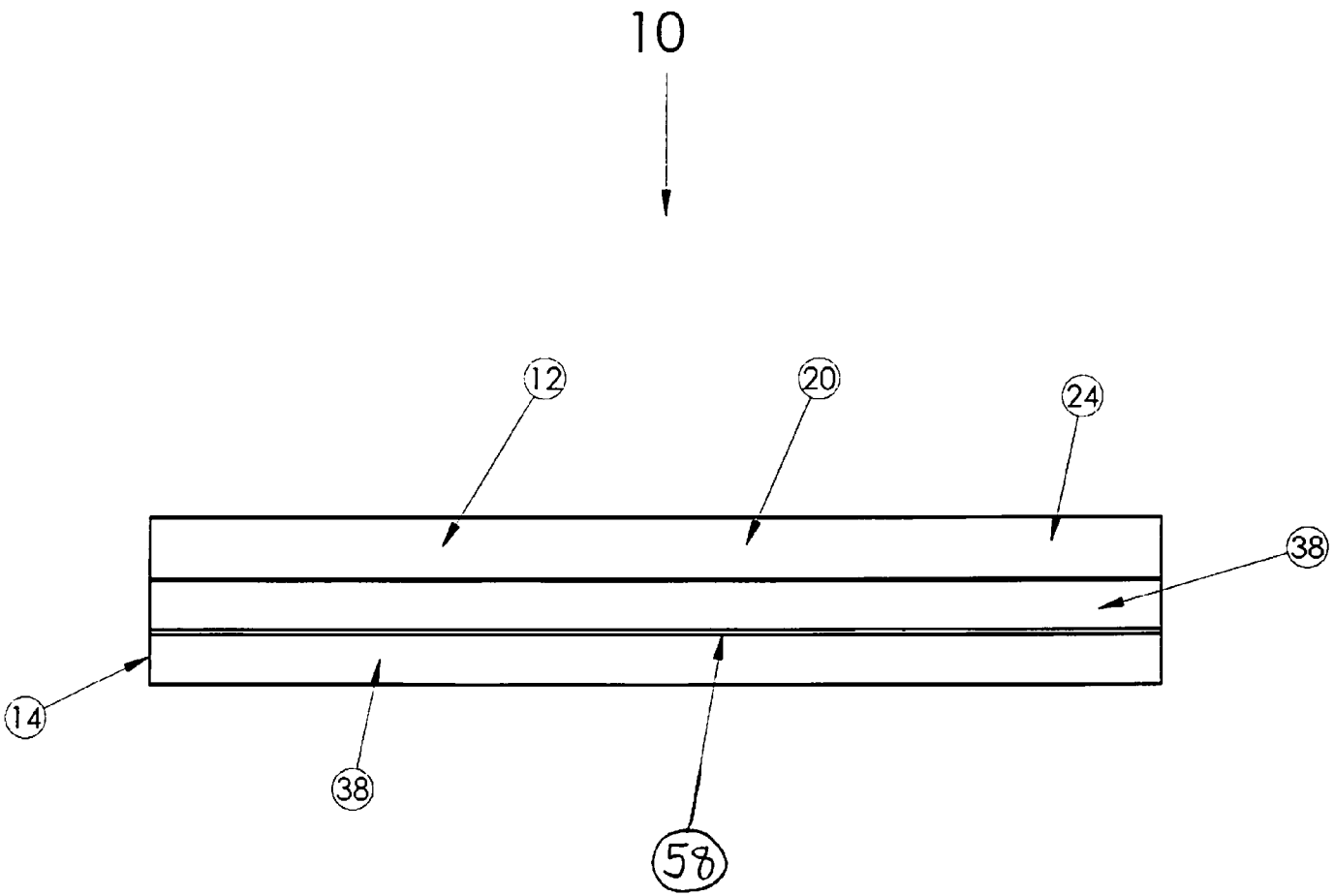
FIG. 5 is a view taken along line 5-5 in FIG. 2.
Figure 6:
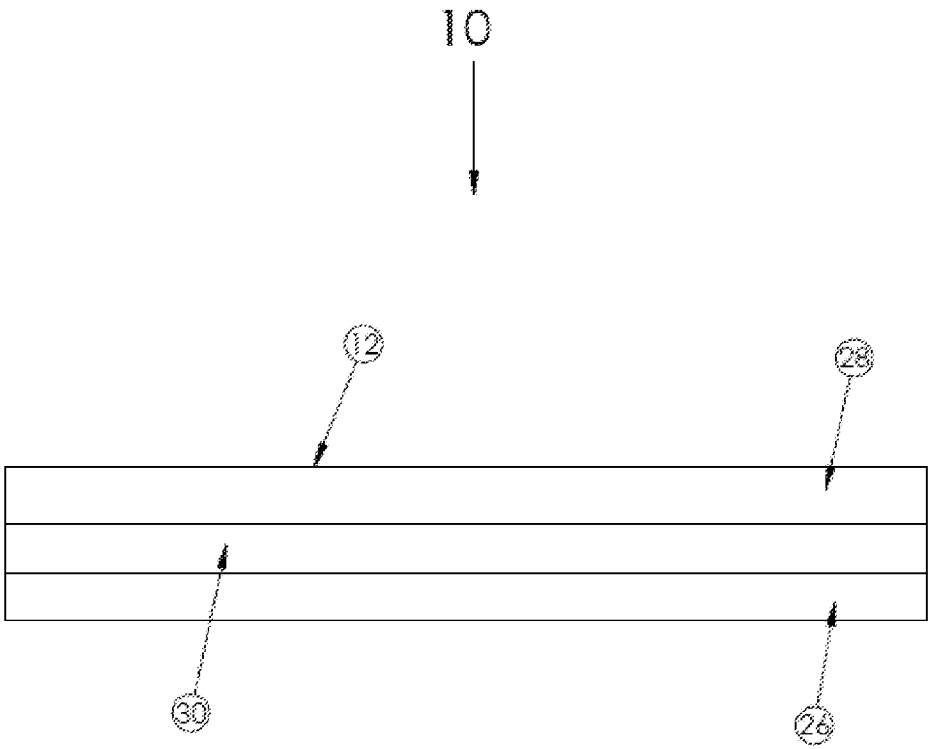
FIG. 6 is a view taken along line 6-6 in FIG. 2.
Figure 8:
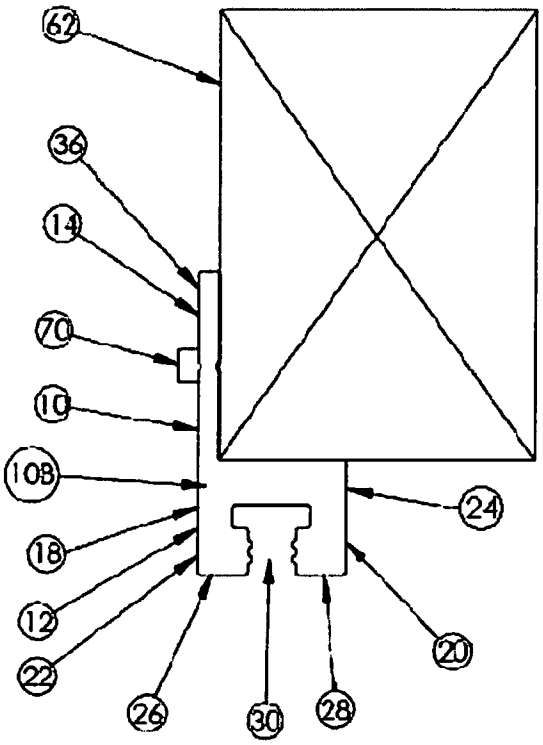
FIG. 8 is a plan view of one configuration wherein the frame member of FIG. 1 is attached to vertical support members for the purpose of forming a screen wall.
Figure 8:
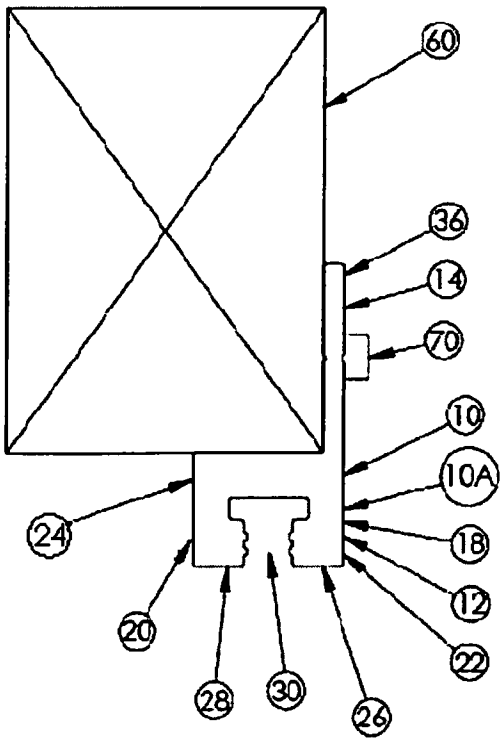
Figure 9:
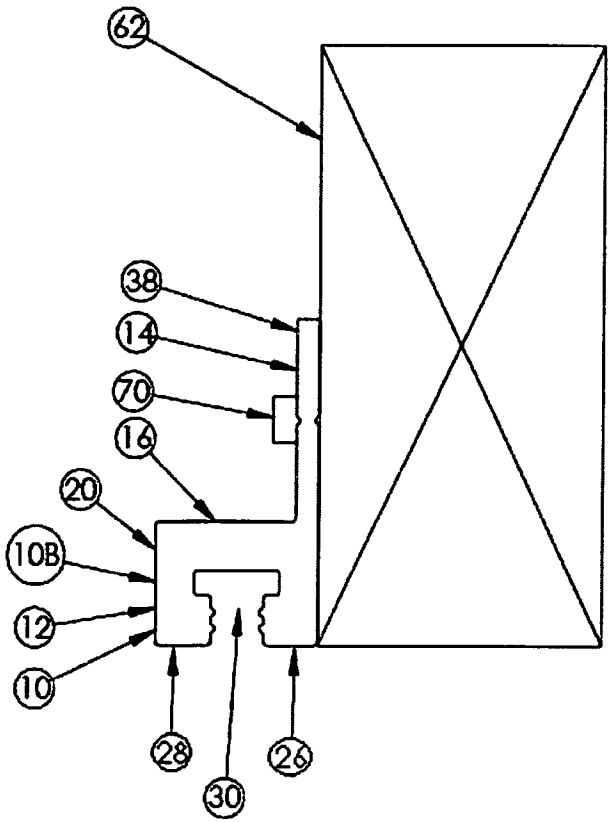
FIG. 9 is another plan view of another configuration wherein the frame member of FIG. 1 is attached to vertical support members for the purpose of forming a screen wall.
Figure 9:
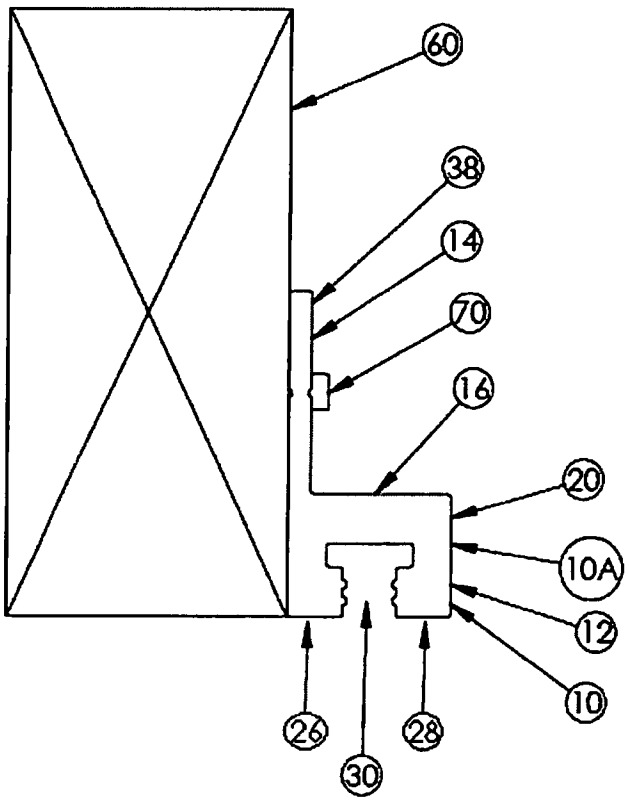

Referring to FIGS. 2, 3 and 7, plate section 14 has longitudinally extending creases 56 and 58 formed therein to facilitate forming openings through plate section 14. Fastening devices such as nails or screws can then be inserted into these openings so as to allow frame member 10 to be attached to structures. For example, as shown in FIG. 8, frame members 10 are attached to vertical support members 60 and 62. The view in FIG. 8 is a plan view of a portion of screen wall. Thus, the view shows the top ends of vertical support members 60 and 62. Vertical support members 60 and 62 may be columns, wooden posts, metal posts, etc. The reference number 10A refers to the frame member 10 that is attached to vertical support structure 60. Similarly, the reference number 10B refers to the frame member 10 that is attached to vertical support structure 62. Fastening devices 70 are driven through creases 56 of plate sections 14 of frame members 10A and 10B such that frame member 10A is attached to vertical support member 60 and frame member 10B is attached to vertical support member 62. Fastening devices 70 can be nails, screws, etc. In the configuration shown in FIG. 8, frame member 10A is mounted to vertical support member 60 in such a manner that rear wall 16 of channel-containing section 12 and surface 38 of plate section 14 contact the surfaces of the vertical support member 60. Similarly, frame member 10B is mounted to vertical support member 62 in such a manner that rear wall 16 of channel-containing section 12 and surface 38 of plate section 14 contact the surfaces of the vertical support member 62. Referring to FIG. 9, frame members 10A and 10B are attached to vertical support members 60 and 62, respectively, in a different manner. Frame member 10A is attached to vertical support member 60 in such a manner that surface 36 of plate section 14 and outer surface 22 of sidewall 18 contact the surface of vertical support member 60. Similarly, frame member 10B is attached to vertical support member 62 in such a manner that surface 36 of plate section 14 and outer surface 22 of sidewall 18 contact the surface of vertical support member 62. Fastening devices 70 are driven through creases 58 of frame members 10A and 10B in order to attached frame members 10A and 10B to vertical support members 60 and 62, respectively.

Figure 7A:
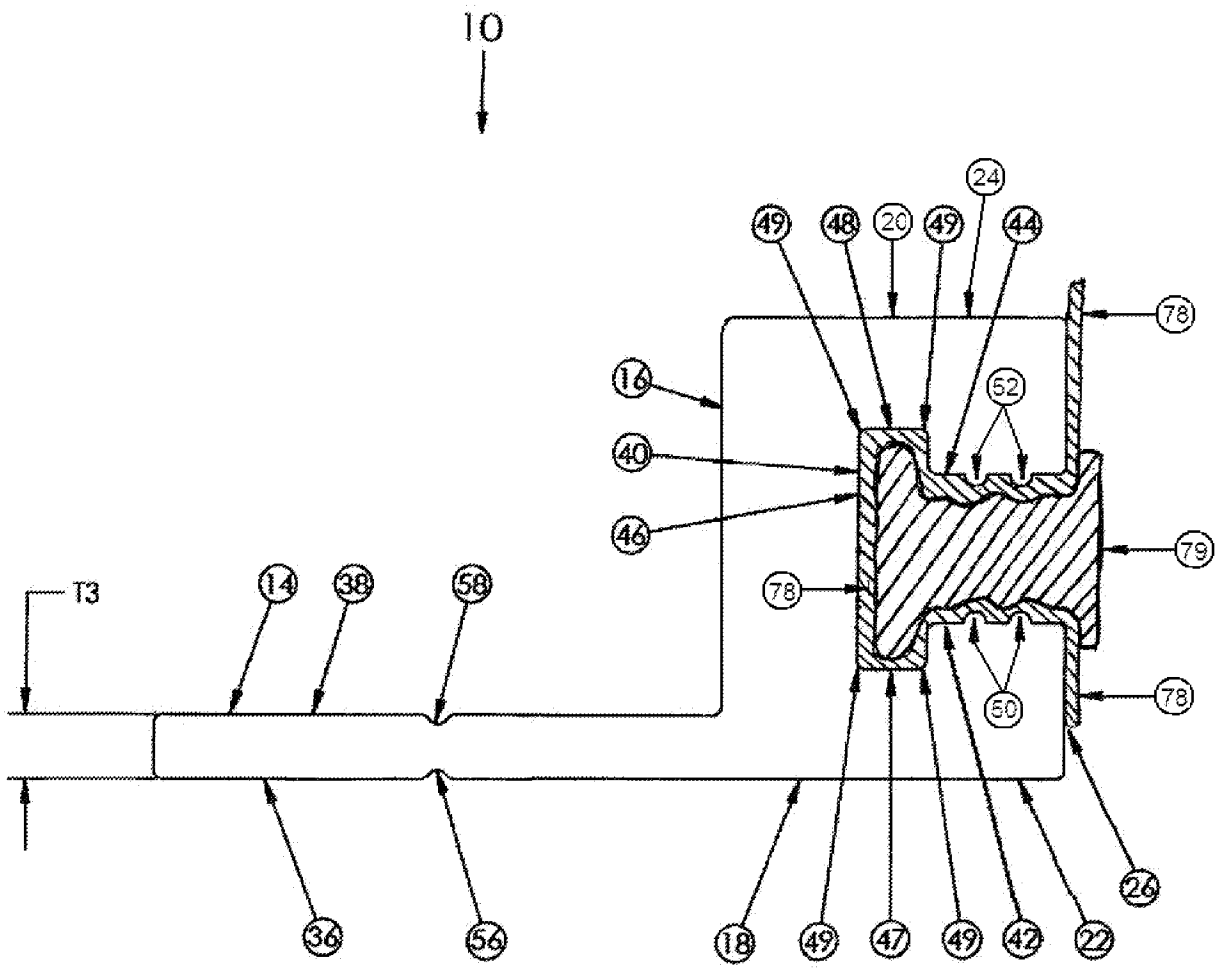
FIG. 7A is a side view, partially in cross-section, of the frame member of FIG. 1 and of screen and spline material secured within the channel of the frame member.

Referring to FIG. 7A, there is shown frame member 10 with screen material 78 disposed within channel 30. Only a portion of screen material 78 is shown in this view. Spline 79 is tightly fitted within channel 30 and retains screen material 78 within channel 30. The material from which spline 79 is fabricated allows it to generally conform to the unique shape of channel 30. Nubs 50 and 52 maintain spline 79 in place and prevent spline 79 from becoming dislodged from channel 30. Nubs 50 and 52 and the shape of channel 30 cooperate to prevent spline 79 from rotating and becoming dislodged from channel 30 when a pulling force is applied to screen material 78. Thus, no matter the direction in which screen material 78 is pulled, the spline 79 will not rotate within channel 30

Figure 10:
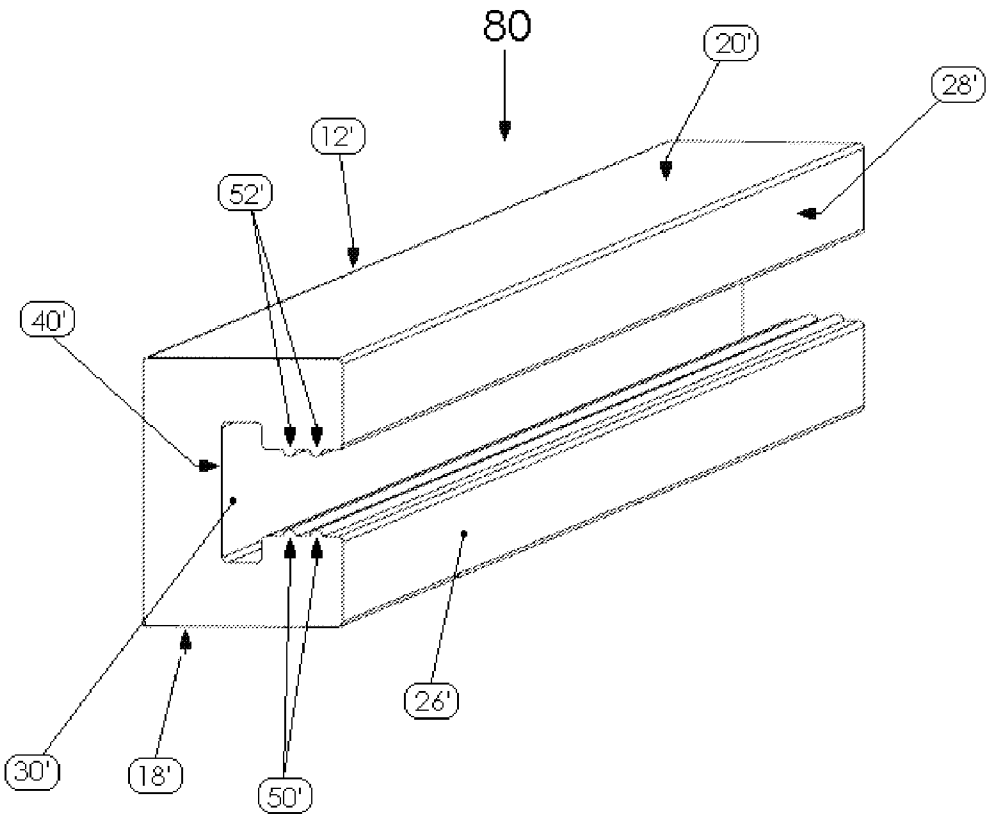
FIG. 10 is a perspective view of a frame member in accordance with another embodiment of the present invention.
Figure 11:
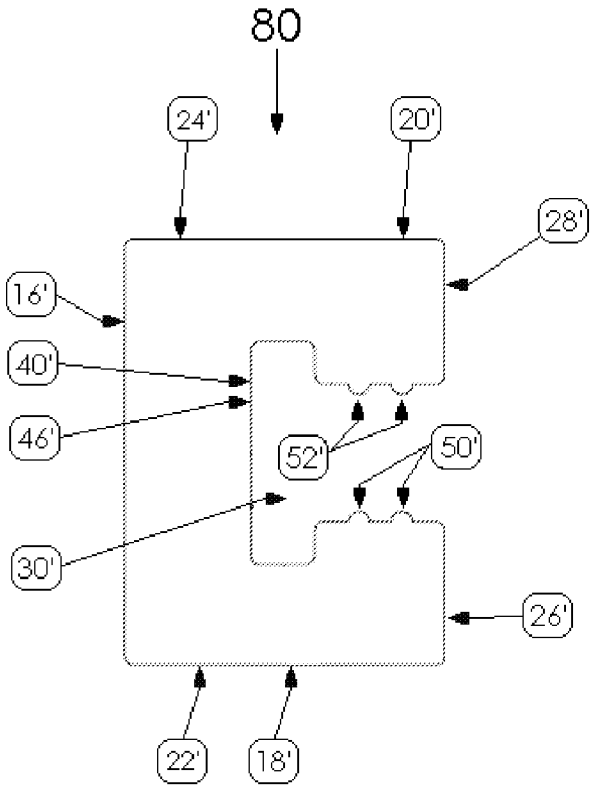
FIG. 11 is a side view of the frame member of FIG. 10.

Referring to FIGS. 10 and 11, there is shown a frame member 80 in accordance with another embodiment of the present invention. Frame member 80 comprises channel-containing section 12' which has the same structure as channel-containing section 12 of frame member 10 shown in FIGS. 1-9. Thus, channel-containing section 12' comprises rear wall 16', sidewall 18' and sidewall 20' which have the same structure and purpose as rear wall 16, sidewall 18 and sidewall 20, respectively, of frame member 10. Channel-containing section 12' further comprises front wall sections 26' and 28' which have the same structure and purpose as front wall sections 26 and 28, respectively, of frame member 10. Frame member 80 further comprises longitudinally extending channel 30' which extends for substantially the entire length of frame member 80. Channel 30' has the same structure, shape, purpose and function as channel 30 of frame member 10. Channel 30' has wall 40' that extends throughout channel 30' and has the same structure, shape, function and purpose as wall 40 of channel 30. Channel wall 40' has rear wall portion 46' that has the same shape as rear wall portion 46 of channel 30 of frame member 10. Channel-containing section 12' further includes a plurality of longitudinally extending nubs 50' and 52' that has the same structure, shape, function and purpose as nubs 50 and 52, respectively, of frame member 10. Frame member 80 can be attached to a structure by any suitable means. For example, holes can be drilled through the rear wall portion 46' of channel wall 40' and nails or screws can then be inserted through these openings in order to attached frame member 80 to a structure.

Figure 12:
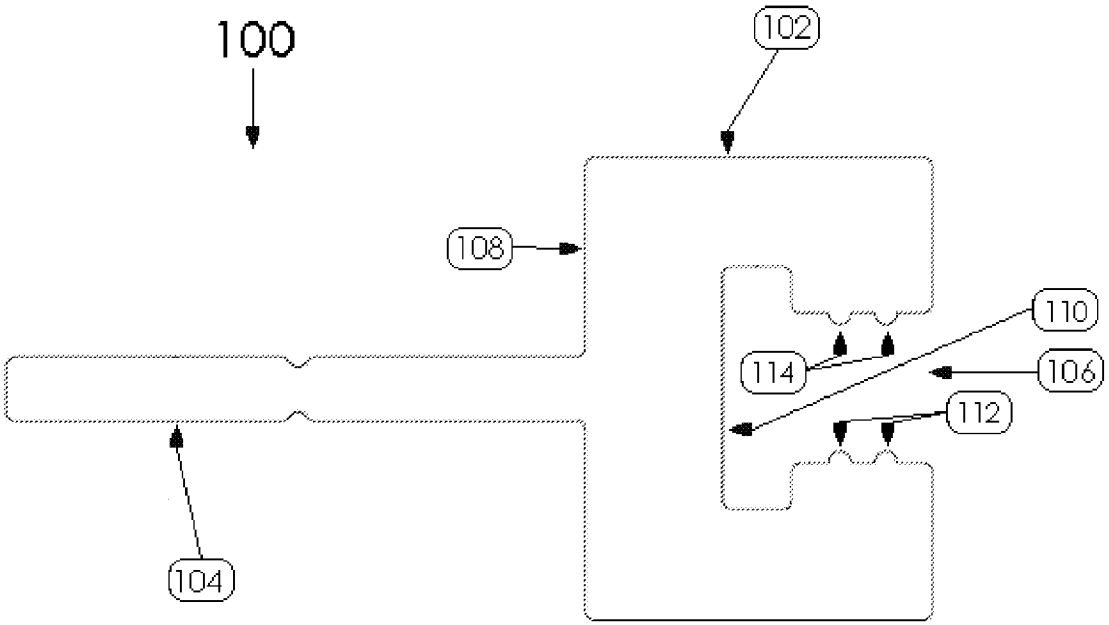
FIG. 12 is a side view of a frame member in accordance with a further embodiment of the present invention.

Referring to FIG. 12, there is shown frame member 100 in accordance with another embodiment of the present invention. Frame member 100 comprises elongate channel-containing section 102 and elongate plate section 104. Channel-containing section 102 has the same structure, shape, purpose and function as channel-containing section 12. Elongate plate section 104 has the same structure, shape, function and purpose of elongate plate section 14. Channel containing section 102 has channel 106 and rear wall 108 which have the same structure, shape, purpose and function as channel 30 and rear wall 16, respectively, of frame member 10. In this embodiment, elongate plate section 104 is attached to channel-containing section 102 at the center of rear wall 108. Channel interior wall 110 extends throughout channel 106. Frame member 100 includes longitudinally extending nubs 112 and 114 on the channel interior wall 110. Nubs 112 and 114 have the same shape, structure, function and purpose as nubs 50 and 52, respectively, of frame member 10.

Figure 13:
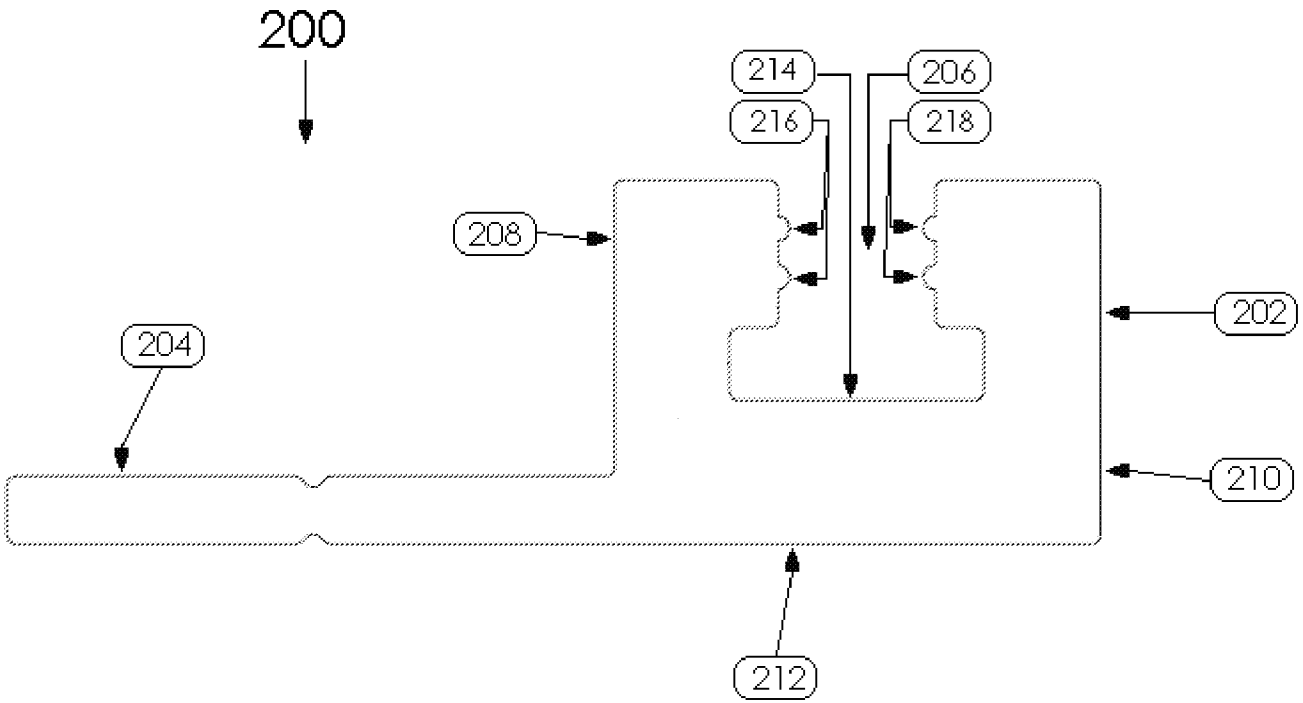
FIG. 13 is a side view of a frame member in accordance with yet another embodiment of the present invention.

Referring to FIG. 13, there is shown frame member 200 in accordance with another embodiment of the present invention. Frame member 200 comprises elongate channel-containing section 202 and elongate plate section 204. Channel-containing section 202 has the same structure, shape, purpose and function as channel-containing section 12 of frame member 10. Elongate plate section 204 has the same structure, shape, function and purpose of elongate plate section 14 of frame member 10. Channel-containing section 202 has channel 206 which has the same structure, shape, purpose and function as channel 30 of frame member 10. Channel-containing section 202 also has sidewalls 208 and 210 and rear wall 212. In this embodiment, elongate plate section 204 is attached to and extends from sidewall 208. Channel interior wall 214 extends throughout channel 206. Frame member 200 further comprises longitudinally extending nubs 216 and 218 on interior wall 214. Nubs 216 and 218 have the same shape, structure, purpose and function as nubs 50 and 52 of frame member 10.

The views in the drawings are for illustrative purposes only. Thus, the present invention contemplates that all dimensions and sizes of frame member 10 may be varied to suit a particular need or application. Frame member 10 can be fabricated from any one of a variety of suitable metals, e.g. aluminum, iron, stainless steel, brass, copper, and/or alloys thereof. Other suitable materials are plastic, resin, PVC, rubber, polycarbonate, wood, composites, etc. If plastic is used to fabricate frame member 10, then it is preferred that an extrusion process be used. In a preferred embodiment, frame member 10 is fabricated from extruded aluminum.

The foregoing description of the preferred embodiments of the invention has been presented for purposes of illustration and description only. It is neither intended to be exhaustive nor to limit the invention to the precise form disclosed; and obviously many modifications and variations are possible in light of the above teaching. Such modifications and variations that may be apparent to a person skilled in the art are intended to be included within the scope of this invention as defined by the accompanying claims.

What is claimed is:

1. A frame member configured to be mounted either inside an opening in a structure or around the opening in the structure, the frame member comprising an elongate channel-containing section and an elongate plate section that extends from the channel-containing section, the channel-containing section having a longitudinally extending channel that comprises a narrow section and a relatively wider section, the narrow section of the channel defining an entrance to the channel, the channel being sized for receiving spline material that secures a screen to the frame member, wherein the channel has an interior wall and wherein the channel-containing section includes a plurality of longitudinally extending nubs located on portions of the interior wall that confront the entrance to the channel, wherein the portions of the interior wall having the longitudinally extending nubs are on opposite sides of the entrance to the channel and wherein the longitudinally extending nubs facilitate retention of spline within the channel, the channel-containing section comprising a rear wall, a first sidewall and a second sidewall, wherein the first and second sidewalls are parallel to each other and wherein the first sidewall has a flat outer surface and the second sidewall has a flat outer surface that is parallel to the flat outer surface of the first sidewall, wherein the interior wall of the channel has flat portions that are located on either side of each longitudinally extending nub and parallel to the flat outer surfaces of the first and second sidewalls, the channel-containing section further comprising a first front wall and a second front wall, wherein the first front wall is contiguous with the first sidewall and perpendicular to the flat outer surface of the first sidewall and the second front wall is contiguous with the second sidewall and perpendicular to the flat outer surface of the second sidewall, wherein the first front wall is located on one side of the entrance to the channel and the second front wall is located on the opposite side of the entrance to the channel, and wherein the first front wall is coplanar with the second front wall, the elongate plate section being attached to and extending from the rear wall of the channel-containing section, wherein the elongate plate section has an outer surface that is coplanar with the flat outer surface of one of the sidewalls of the channel-containing section so as to enable the outer surfaces of both said elongate plate section and said one of the sidewalls of said channel-containing section to directly contact a structure when the frame member is mounted inside an opening in the structure.

2. The frame member according to claim 1 wherein the elongate plate section has a longitudinally extending crease therein to facilitate forming openings through the elongate plate section so as to enable the frame member to be attached to a structure.

3. The frame member according to claim 1 wherein the frame member is fabricated from metal.

4. The frame member according to claim 3 wherein the frame member is fabricated from a metal chosen from the group consisting of aluminum, steel, iron, stainless steel, brass, copper or alloys thereof.

5. The frame member according to claim 1 wherein the frame member is fabricated from a material chosen from the group consisting of plastic, resin, PVC, rubber, and composite materials.

6. A frame member configured to be mounted either inside an opening in a structure or around the opening in the structure, the frame member comprising an elongate channel-containing section having a longitudinally extending channel that comprises a narrow section and a relatively wider section, the narrow section of the channel defining an entrance to the channel, the channel being sized for receiving spline material that secures a screen to the frame member, wherein the channel has an interior wall and wherein the channel-containing section includes a plurality of longitudinally extending nubs located on portions of the interior wall that confront the entrance to the channel, wherein the portions of the interior wall having the longitudinally extending nubs are on opposite sides of the entrance to the channel and wherein the longitudinally extending nubs facilitate retention of spline within the channel, the channel-containing section comprising a rear wall, a first sidewall and a second sidewall, wherein the first and second sidewalls are parallel to each other and wherein the first sidewall has a flat outer surface and the second sidewall has a flat outer surface that is parallel to the flat outer surface of the first sidewall, the channel-containing section further comprising a first front wall and a second front wall, wherein the first front wall is contiguous with the first sidewall and perpendicular to the flat outer surface of the first sidewall and the second front wall is contiguous with the second sidewall and perpendicular to the flat outer surface of the second sidewall, wherein the first front wall is located on one side of the entrance to the channel and the second front wall is located on the opposite side of the entrance to the channel, and wherein the first front wall is coplanar with the second front wall, wherein the interior wall has flat portions that are (i) located on either side of each longitudinally extending nub, (ii) parallel to the flat outer surfaces of the first and second sidewalls and (iii) perpendicular to the first and second front walls, the frame member further comprising an elongate plate section attached to and extending from the rear wall of the channel-containing section, wherein the elongate plate section has an outer surface that is coplanar with the flat outer surface of the first sidewall of the channel-containing section so as to enable the outer surface of the elongate plate section and the flat outer surface of the first sidewall of the channel-containing section to directly contact a structure when the frame member is mounted inside an opening in the structure.

* * * * *